United States Patent [19]

Rankin

[11] Patent Number: 4,606,485

[45] Date of Patent: Aug. 19, 1986

[54] SURVEYOR'S RIBBON DISPENSER

[76] Inventor: Freddy D. Rankin, Rte. 2, Box 998, Bladenboro, N.C. 28320

[21] Appl. No.: 746,423

[22] Filed: Jun. 19, 1985

[51] Int. Cl.[4] ..... B65D 85/672

[52] U.S. Cl. ..... 225/78; 225/66; 225/79; 225/82; 225/90; 225/91

[58] Field of Search ..... 225/78–80, 225/82, 66, 73, 91

[56] References Cited

U.S. PATENT DOCUMENTS

| | | | |
|---|---|---|---|
| 947,997 | 2/1910 | Riley | 242/55.2 |
| 2,470,250 | 5/1949 | Kienle | 242/55.4 |
| 2,581,190 | 1/1952 | Hodges | 225/78 X |
| 2,818,221 | 12/1957 | Thieman | 225/73 X |
| 3,125,264 | 3/1964 | English, Jr. | 225/78 |
| 3,149,764 | 9/1964 | Waltz | 225/66 X |
| 3,589,634 | 6/1971 | Mason | 242/55.3 |
| 3,709,445 | 1/1973 | Adams | 242/55.2 |
| 4,088,276 | 5/1978 | Littleton | 242/55.3 |
| 4,093,138 | 6/1978 | Shafer | 242/55.2 |
| 4,195,794 | 4/1980 | Ricci et al. | 242/99 |

*Primary Examiner*—Frank T. Yost

*Attorney, Agent, or Firm*—Dowell & Dowell

[57] ABSTRACT

A surveyor's ribbon or tape dispenser which is designed to be carried on a person's belt which includes a reel from which a ribbon tape may be selectively dispensed by urging the ribbon or tape outwardly beyond the end of and against the pressure of a spring biased retention arm and which also includes a fixed U-shaped cutter element mounted along an intermediate portion of the retention arm at a point spaced from the end thereof for use in severing a selected portion of the ribbon or tape from the reel.

9 Claims, 4 Drawing Figures

SURVEYOR'S RIBBON DISPENSER

BACKGROUND OF THE INVENTION

1. Field of the Invention

This invention is generally directed to ribbon or tape dispensing reels and more specifically to a dispensing reel which is specifically designed for dispensing tapes or ribbons such as surveyor's ribbons and which is adapted to be worn by a person in the field. The dispenser is provided with means for insuring that the ribbon or tape is not prematurely dispensed and further that any material being dispensed may be safely severed by the user in such a manner that a portion of the material remaining on the reel is readily accessible for subsequent manipulation by the user.

2. History of the Prior Art

There have been numerous innovations directed to dispensers of ribbons and tapes of all types. Many prior art dispensers are specifically designed to be portable or carried by a person and may include means for attaching the dispenser to an article of clothing or belt. Such portable dispensers facilitate access to the material being dispensed but are often not adequate for use under certain types of conditions. In surveying, the surveyor must have access to the surveying ribbon tape in situations such as when traversing through thick underbrush, dense forests and other hostile terrains and environments. If the dispenser is not both rugged and durable, it could easily be lost or destroyed as the surveyor moves through the rough terrain. In addition, branches and limbs may easily dislodge ribbon which is loosely mounted on a dispensing reel or may otherwise damage the dispensing reel thereby creating great inconvenience for the surveyor.

In addition to the foregoing, many prior art tape or ribbon dispensers which are designed to be portable in nature do not provide safe cutting means for severing a selected portion of the ribbon from the reel. Often, the cutting edge is exposed along an outwardly exposed or protruding extremity of the dispenser in such a manner that possible injury may result to a person using the dispenser.

Another problem encountered with the prior art tape or ribbon dispensers is that access to the tape or ribbon on the roll is not always convenient. In field use, it is extremely beneficial that a person not have to waste time locating the end of the material on the reel in order to selectively pull a section of the material therefrom. In prior art dispensers where the cutting edge is mounted adjacent the periphery of the tape or ribbon, once a section of the material has been dispensed it is difficult to grasp the end of the material as it is generally retained between the cutting edge and the reel. This is particularly inconvenient if the tape or ribbon is positively retained on the reel by some mechanical means.

Some examples of prior art tape dispensers include U.S. Pat. Nos. 947,997 to Riley; 2,470,250 to Kienle; 3,589,634 to Mason; 3,709,445 to Adams; 4,088,276 to Littleton; 4,093,138 to Shafer; and 4,195,794 to Ricci et al.

SUMMARY OF THE INVENTION

This invention is directed to a surveyor's ribbon or tape dispenser which is designed to be attached to an article of clothing worn by a person and which includes a ribbon dispensing reel mounted on a spindle and which reel is frictionally prevented from free rotation by a spring loaded or biased ribbon or tape retention arm having an end portion which overlies and confines the outer portion of the ribbon carried by the spindle. The outermost portion of the ribbon dispensing arm is rounded or curved so as to facilitate the movement of ribbon or tape beyond the end thereof. A cutter element of a generally U-shaped configuration is mounted along an intermediate portion of the retention arm so as to be in spaced relationship with respect to the end portion thereof with the cutting edges being defined by the outer and lowermost portions of the U-shaped element. The spring for biasing the retention arm is mounted in a protected location beneath an outwardly extending flange portion which extends from the mounting or body portion of the dispenser. The dispensing reel is carried by the spindle is retained thereon by a flanged locking plate which is secured adjacent one face or side of the reel.

It is a primary object of the this invention to provide a dispenser for selectively dispensing surveyor's ribbon or tape which is adapted to be worn by a person and which permits the ribbon to be securely retained on the dispensing reel until selectively manually urged therefrom.

It is a further object of the present invention to provide a surveying ribbon or tape dispenser which may be worn by a person in the field and which includes a cutting means which is shielded within the lower portions of a U-shaped cutting member so as to prevent the user's hands from coming into engagement with the cutting edges thereof and thereby prevent injury to the person using the dispenser.

It is a further object of the present invention to provide a surveying ribbon or tape dispenser which is adapted to be worn by a person in the field wherein the ribbon or tape is retained on the reel by a spring biased retention arm and wherein a cutter element for the ribbon is mounted in spaced relationship from the end of the biased retention arm so that a segment of ribbon or tape remains extended beyond the end of the arm after a portion of ribbon or tape has been severed from the reel thereby permitting easy access to the ribbon or tape for subsequent dispensing.

It is also an object of the present invention to provide a simplified and yet durable dispenser which may be worn by a surveyor in the field and which permits the dispensing of ribbon or tape even in harsh or adverse environments.

DESCRIPTION OF THE PREFERRED EMBODIMENT

Figure 1:
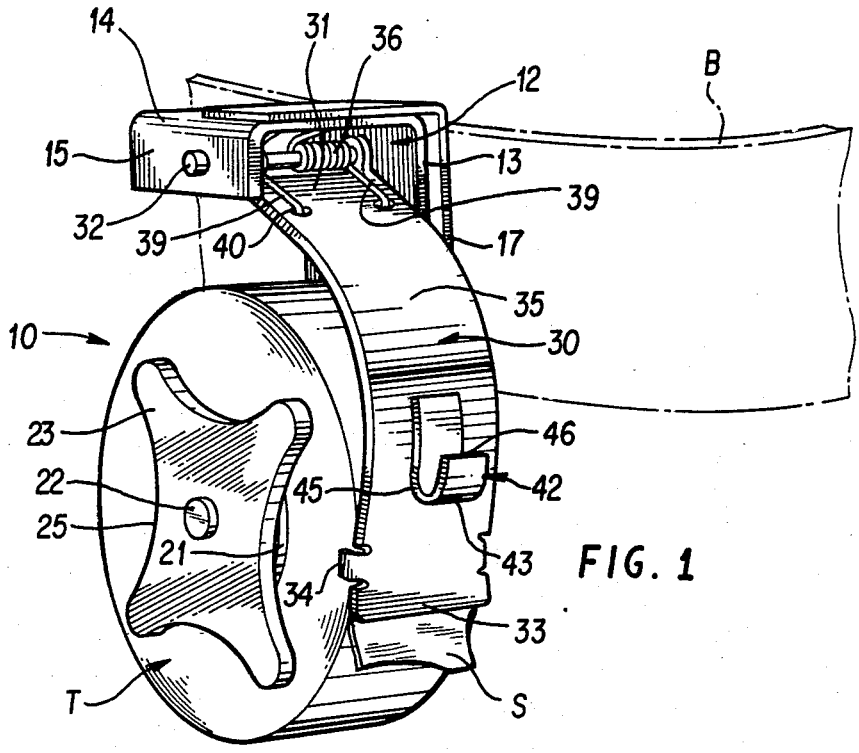
FIG. 1 is a perspective view of the ribbon dispensing apparatus of the present invention as it shown being mounted to a section of a person's belt.

With continued reference to the drawings, the surveyors ribbon or tape dispenser 10 of the present invention is shown in FIG. 1 as it is selectively mounted to a person's belt B. The dispenser includes a generally L-shaped frame member 12 having a vertically extending side wall 13, an upper wall 14 and a shortened depending flange portion 15 which extends downwardly from one end of the upper wall portion in generally perpendicular relationship with the elongated side wall portion 13. A generally L-shaped clip member 16 is riveted or otherwise secured to the upper portion or wall of the frame member 12 and includes a vertically extending belt engaging portion 17 which extends generally in parallel relationship with the vertically extending side wall 13 of the frame member 12. For purposes of facilitating the secure mounting of the apparatus to the belt B, the belt engaging portion 17 of the clip may be slightly beveled outwardly away from the side wall 13 of the frame 12 as shown at 18. The belt retaining clip is formed of a spring-like material so that the belt engaging portion thereof is resiliently biased toward the vertical side wall 13 of the L-shaped frame 12 to thereby securely retain the belt therebetween.

A reel mounting spindle 20 is mounted to the lower portion of the vertically extending side wall 13 of the L-shaped frame member 12 and extends generally perpendicularly with respect thereto. The spindle may be either fixedly or rotatably mounted to the vertically extending side wall and extends outwardly from the side wall a distance generally equal to the distance between the flange portion 15 of the frame member 12 and the side wall portion thereof. The diameter of the spindle is such as to cooperatively receive a spool 21 of a reel of surveying ribbon or tape T.

Figure 2:
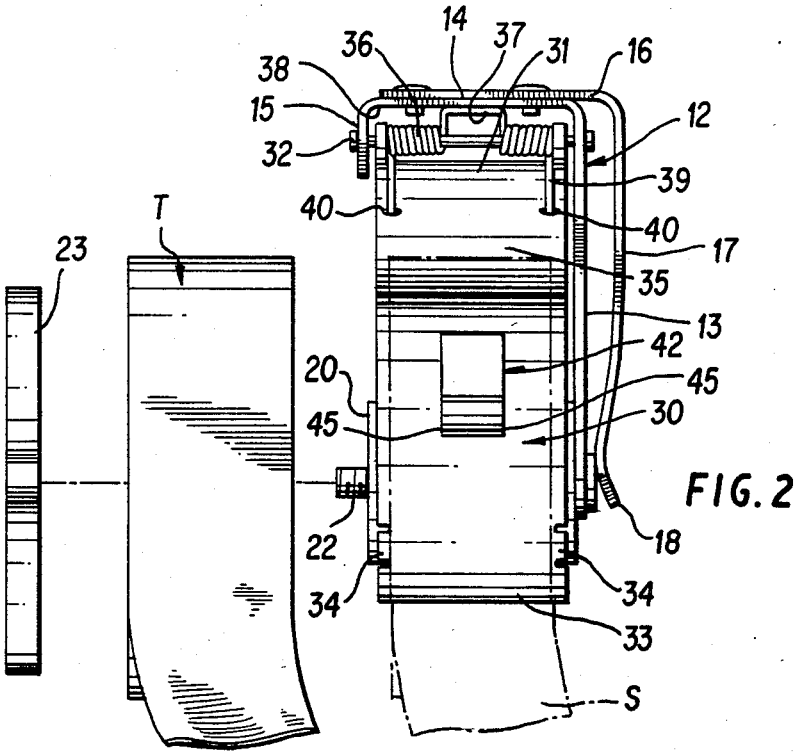
FIG. 2 is a front plan assembly view of the ribbon dispensing apparatus showing the ribbon reel and reel engaging plate in disassembled relationship.
Figure 3:
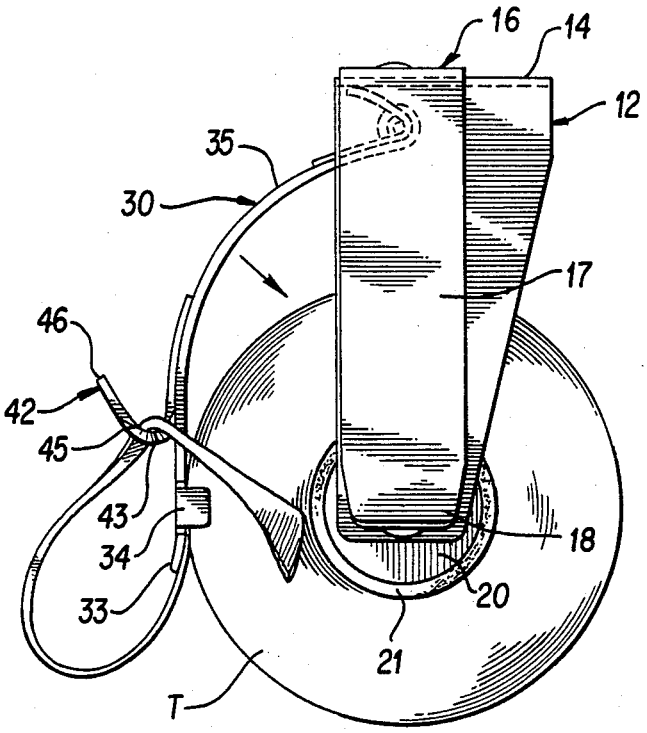
FIG. 3 is a right side view of the surveyor ribbon dispensing apparatus of the present invention.
Figure 4:
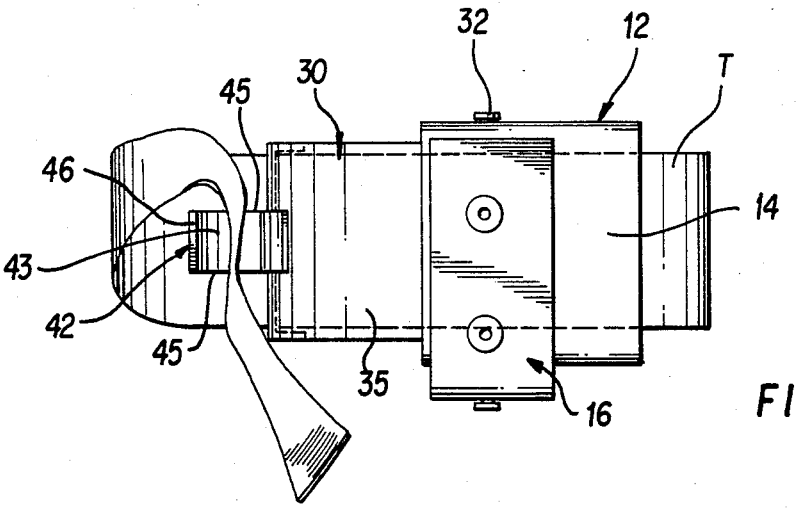
FIG. 4 is a top plan view of the surveyor tape dispensing apparatus of the present invention showing the end portion of the ribbon in overlying relationship with the U-shaped cutter element.

In order to secure the reel in mounted position on the spindle 20, the spindle is provided with a central screw threaded member 22 to which a separable reel engaging plate 23 is threadingly secured as shown in assembly view in FIG. 2.

The shape of the plate 23 may vary and may include outwardly extending elements 24 which will abut the edges of the ribbon or tape T mounted to the spool 21 to prevent the ribbon or tape from shifting laterally with respect to the spool during use. Portions of the plate 23 may be indented as shown at 25 to facilitate manipulation of the plate on the threaded member 22.

The ribbon or tape is further secured on the reel by a ribbon or tape retention arm 30. The retention arm is generally arcuately shaped and has a first end portion 31 which is retained beneath the upper wall 14 of the frame member 12 by a pin means 32 which extends between the flange portion 15 and the upper portion of the side wall 13 as shown in FIGS. 1 and 2. The outer or lower end 33 of the retention arm 30 is shown as being beveled or flared outwardly away from the periphery of the reel of ribbon or tape T. A pair of flange members 34 are formed inwardly of the end portion of the retention arm and extend generally perpendicularly with respect to the outer face 35 of the retention arm 33. As shown in FIG. 1, the flange members 34 extend inwardly along either side of the ribbon or tape and toward the spindle 20.

In order to bias the retention arm against the outer surface of the ribbon or tape to prevent its accidental displacement from the reel, a spring 36 is mounted about the pin member 32 so as to be housed beneath the upper wall 14 of the frame member 12. The spring 36 is shown having an inner arm portion 37 which engages the under surface 38 of the upper wall portion 14 and two outer portions 39 which are engaged within openings 40 within the upper portion of the tape retention arm. The action of the spring urges the lower or forward end portion 33 of the retention arm toward the spindle member 20.

It is necessary that sufficient clearance be provided between the retaining plate 23 and the inwardly extending flange portions 34 adjacent the end 33 of the retention arm 30. Therefore, the length of the spindle should be slightly greater than the distance between the flange members 34. In this manner, the end of the retention arm and the flange members may pass inwardly of the retaining plate 23 as the end of the tape retention arm is moved toward the central axis of the spindle as ribbon or tape is dispensed from the reel.

It is of utmost importance to provide a safe means for severing a section of ribbon or tape from the reel. To this end, a generally U-shaped cutter element 42 is welded or otherwise attached intermediate the upper 31 and outer 33 end portions of the retention arm 30. The side edges of the lowermost portion 43 of the side edges of the U-shaped cutter element are filed down or otherwise treated to form generally arcuate cutting edges 45 on either side of the lower portion of the U-shaped cutter element. The cutting edges 45 are spaced remotely from the upper and outer end portion 46 of the U-shaped cutter element. In this manner, the cutting edges are concealed from being directly contacted by a person utilizing the dispensing apparatus apparatus by a vertical movement of the hand with respect to the cutter element. As the cutters are disposed along a remote horizontally oriented portion of the U-shaped element, they will function to cut the material carried on the spindle as it is cradled within the lower portion of the element and pulled downwardly and horizontally with respect thereto. This configuration prevents the accidental injury to an appendage or hand of the user.

The spacing of the cutter element 42 with respect to the end portion 33 of the retention arm 30 is important to insure that a residual segment of tape or ribbon S remains which extends outwardly beyond the end portion of the retention arm after each segment of ribbon or tape is cut from the dispensing reel. It is generally preferred that the spacing between the end portion 33 of the retention arm 30 and the cutting edges 45 of the U-shaped cutting element 42 by at least approximately one inch to thereby provide at least a one inch segment S which can be grasped by the user of the device during a subsequent dispensing operation.

As the surveying ribbon dispenser of the present invention is designed for use in harsh terrain which may include thick underbrush, it is preferred that the apparatus be fabricated having a metallic frame member and a metallic retention arm and spring clip although a durable plastic material may be suitable for some anticipated uses. The spindle member and reel engaging plate may be formed of a wood, metal or plastic material.

In use of the dispensing device of the present invention, the reel retention plate 23 is removed from the spindle 20 and a roll of ribbon or tape such as surveyor's ribbon is placed in engagement over the spindle. Thereafter the ribbon reel retention plate is threadingly engaged with the central screw shaft of the spindle and tightened into position so as to be adjacent the edges of the reel of ribbon or tape. The dispensing apparatus may subsequently be clipped to the user's pocket or belt by utilizing the mounting clip 16. It is preferred that the apparatus be worn so that the tape retention arm extends forwardly of the user so that the cutting element is also positioned forwardly of the user.

When it is desired to dispense a section of ribbon or tape, the surveyor need only pull the end of the material outwardly with respect to the forward end of the retention arm, thereafter lifting the tape vertically upwardly and placing it into the U-shaped cutter element. A downward and horizontal motion with respect to the cutting edges of the cutter element will sever the tape or ribbon from the remaining portion of the material on the reel insuring that at least a segment of ribbon or tape remains extending from the end portion of the retention arm.

As the outer end portion of the retention arm is beveled outwardly with respect to the axis of the spindle, the tape or ribbon will not be prematurely severed before being cut within the U-shaped cutter element. As the ribbon or tape is dispensed, the retention arm will be continually biased toward the spindle to thereby retain the ribbon or tape in position until a force is placed on the end or residual segment of the material by the surveyor in the field.

I claim:

1. A dispensing apparatus for dispensing selective segments of material from a reel of material comprising a frame member having an elongated side wall and an upper wall extending outwardly with respect to said side wall, an elongated clip means attached to said frame member so as to be in generally parallel relationship to said side wall, a spindle means having a first end mounted to said side wall and a second end extending outwardly therefrom in spaced relationship to said upper wall of said frame member, a plate means mounted to said second end of said spindle, a material engaging retention means carried by said frame member and having first and second ends and inner and outer surfaces, said first end of said retention means being disposed in underlying relationship adjacent said upper wall of said frame member, said second end portion of said retention means extending outwardly between said plate means and said side wall of said frame member, means for biasing said second end of said retention means toward said spindle means, and a cutter means mounted to said outer surface of said retention means in spaced relationship from said second end thereof.

2. The dispensing apparatus of claim 1 in which said cutter means includes a generally U-shaped member having an outer leg portion which extends in spaced relationship with respect to said outer surface of said retention means, and at least one cutting edge defined by a side edge portion of said U-shaped member.

3. The dispensing apparatus of claim 2 wherein said cutter means has at least one cutting edge formed within the lowermost portion of said U-shaped member so as to be on the outer edge portion thereof.

4. The dispensing apparatus of claim 2 including a pair of spaced flange means disposed adjacent said second end portion of said retention means and extending outwardly therefrom toward said spindle means.

5. The dispensing apparatus of claim 4 in which said second end of said retention means is angled outwardly with respect to said spindle means.

6. The dispensing apparatus of claim 5 in which said retention means is generally arcuately shaped between said first and second ends thereof.

7. The dispensing apparatus of claim 6 in which said means for biasing said second end of said retention means includes a spring means mounted adjacent said first end portion of said retention means, said spring means being positioned in underlying relationship adjacent said upper wall of said frame member.

8. A surveyor's ribbon dispensing apparatus for dispensing selected segments of ribbon from a reel of ribbon comprising a frame member having a generally vertically oriented side wall, an upper wall extending outwardly from one end of said side wall, and a flange member extending generally parallel with said side wall and extending downwardly from said upper wall of said frame member, a pin means disposed between said flange member and said side wall of said frame member, a ribbon supporting spindle means mounted to said side wall portion of said frame member and extending outwardly therefrom in underlying relationship with respect to said upper wall thereof, said spindle means having a first end mounted adjacent to said side wall portion of said frame member and a second end spaced outwardly thereof, a plate means mounted adjacent said second end of said spindle means and being removably with respect thereto, a ribbon retention arm having first and second ends and inner and outer surfaces, said first end of said tape retention arm being mounted to said pin means, said second end of said ribbon retention arm being beveled outwardly with respect to said spindle means, a pair of flange means provided adjacent said second end of said retention means and extending inwardly toward said spindle means, spring means mounted adjacent said first end of said retention arm for urging said second end thereof toward said spindle means, and a cutting means mounted along said outer surface of said retention arm and in spaced relationship with respect to said second end thereof, said cutter means having at least one cutting edge disposed intermediate its length and having a first leg portion extending forwardly with respect to said retention arm.

9. The dispensing apparatus of claim 8 in which said cutting means is generally U-shaped having first and second leg portions connected by a lower portion, said second leg portion being mounted in generally flush engagement with said outer surface of said retention arm and said first leg portion spaced outwardly therefrom, said cutting edge being formed in said lower portion of said U-shaped element so as to be intermediate said first and second leg portions.

* * * * *